US006600299B2

(12) United States Patent
Xi

(10) Patent No.: US 6,600,299 B2
(45) **Date of Patent: *Jul. 29, 2003**

(54) MILLER COMPENSATED NMOS LOW DROP-OUT VOLTAGE REGULATOR USING VARIABLE GAIN STAGE

(75) Inventor: Xiaoyu (Frank) Xi, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/025,320

(22) Filed: Dec. 19, 2001

(65) Prior Publication Data

US 2003/0111986 A1 Jun. 19, 2003

(51) Int. Cl.[7] ..... G05F 1/40
(52) U.S. Cl. ..... 323/280
(58) Field of Search ..... 323/280, 316, 323/313, 274

(56) References Cited

U.S. PATENT DOCUMENTS 5,168,209 A * 12/1992 Thiel, V ..... 323/313
5,563,501 A * 10/1996 Chan ..... 323/282
5,631,598 A * 5/1997 Miranda et al. ..... 327/540
6,246,221 B1 * 6/2001 Xi ..... 323/280

* cited by examiner

*Primary Examiner*—Shawn Riley
(74) *Attorney, Agent, or Firm*—William B. Kempler; W. James Brady, III; Frederick J. Telecky, Jr.

(57) ABSTRACT

A high power supply ripple rejection (PSRR) internally compensated low drop-out voltage regulator using an output NMOS pass device. The voltage regulator uses an inverting inter-stage variable gain amplifier to adjust its gain in response to a load current passing through the output NMOS device such that as the load current decreases, the gain increases, wherein a second pole associated with the voltage regulator is pushed above a unity gain frequency associated with the voltage regulator. The inverting inter-stage variable gain amplifier is further operational to adjust its gain in response to a load current passing through the power NMOS device such that as the load current increases, the gain decreases, wherein the unity gain bandwidth associated with the loop formed by a compensation capacitor is kept substantially constant.

27 Claims, 9 Drawing Sheets

MILLER COMPENSATED NMOS LOW DROP-OUT VOLTAGE REGULATOR USING VARIABLE GAIN STAGE

BACKGROUND OF THE INVENTION

1. Field of the Invention

This invention relates generally to voltage regulators, and more particularly to a Miller compensated NMOS low drop-out (LDO) voltage regulator using an inverting variable gain stage to improve stability and optimize power supply rejection ratio (PSRR).

2. Description of the Prior Art

Active compensating capacitive multiplier structures and techniques, e.g. nested Miller compensation, are well known in the art. The specific type of compensating circuit used is dependent upon the particular application. One application of improving phase margin for example, takes advantage of the Miller Effect by adding a Miller compensation capacitance in parallel with an inverting gain stage, e.g., the output stage of a two stage amplifier circuit. Such a configuration results in the well-known and desirable phenomenon called pole splitting, which advantageously multiplies the effective capacitance of the physical capacitor employed in the circuit. See, e.g., for background on compensation of amplifier circuits using Miller-compensating capacitance, Paul R. Gray and Robert g. Meyer, *Analysis and Design of Analog Integrated Circuits*, Third Ed., John Wiley & sons, Inc. New York, 1993, Ch. 9, especially pp. 607–623.

A typical architecture of a Miller compensated NMOS LDO voltage regulator 100 is shown in FIG. 1. The LDO 100 comprises an error amplifier A1, an inverting inter-stage gain amplifier A2, a low impedance driver BUF, a NMOS power transistor NSW, feedback resistors R1 and R2, and an output filter capacitor C_FILT with equivalent series resistor (ESR) R_ESR. It can be seen that the inverting inter-stage gain amplifier A2 and the low impedance driver BUF get their supply from a charge pump 102, that allows the gate of the NMOS power transistor NSW to be pulled up much higher than its drain, thus broadening the input range of the LDO 100. It can be appreciated that the charge pump 102 is generally shared by multiple NMOS LDO's.

Similar to PMOS LDO's, the ultra-wide range of load current Iout 104 (usually from 10's $\mu$A to 100's mA) and the large output filter capacitor C_FILT (1 $\mu$F to 10 $\mu$F) also present significant challenges associated with compensation design for NMOS LDO's. The LDO 100 depicted in FIG. 1, for example, will very likely remain unstable if no special effort is taken to stabilize the Miller compensation loop. An analysis of the LDO 100 demonstrates the inter-stage gain amplifier A2 serves a critical function to split the poles. Amplifier A2 is expected to have high enough gain under low current conditions to push the second pole close or beyond unity gain bandwidth of the LDO. This high gain can be problematic however, under high load conditions where the second pole may be pushed up to a few MHz. Since this second pole is also the unity gain bandwidth of the Miller compensation loop itself, this huge bandwidth nearly always guarantees this loop is unstable, given the multiple stages inside the loop which all contribute to phase shift, albeit at a fairly high frequency range. Since the LDO 100 is a 4-pole system, the unity gain bandwidth must be close to or less than the second highest pole, or the system 100 will become unstable.

In view of the foregoing, a need exists for an LDO amplifier circuit architecture and technique capable of achieving better stability and higher PSRR performance from an internally compensated NMOS low drop-out voltage regulator than that presently achievable using conventional "Miller" or "Pole-splitting" techniques presently known in the art.

SUMMARY OF THE INVENTION

The present invention is directed to a circuit architecture and technique for achieving good phase margin, highly desirable open-loop gain, and high power supply ripple rejection (PSRR) from an internally compensated NMOS low drop-out voltage regulator that is implemented to formulate a modified type of Miller compensation. This good phase margin and high open-loop gain is achieved by using an inverting variable gain stage that ensures the dominant pole is always at the same internal node regardless of load current (no "pole swapping" allowed). The present circuit further provides high PSRR by implementing the inverting variable gain single stage amplifier such that a differential input has one input tied to $C_c$ while the other is at a dc voltage referenced to ground. Properly setting the input reference improves the PSRR.

A conventional NMOS low drop-out voltage regulator is generally comprised of two gain stages in order to promote simplification of any related compensated closed loop system. The input stage of such a voltage regulator is formulated via a differential amplifier. The output stage comprises a series pass NMOS device. These two stages are generally coupled together via an impedance buffer, typically a source follower, to enable the input stage high impedance output to drive the large gate capacitance of the series pass NMOS device and thereby minimize the effect of an internal pole that would otherwise interfere with loop compensation. Miller capacitor multiplication, or "Pole-splitting", is generally used by those skilled in the art to internally compensate the voltage regulator for use with ceramic output capacitors where the circuit designer cannot rely on an external compensating zero formed by the ESR associated with an electrolytic capacitor. Generally, the Miller capacitor is tied across an inverting amplifier, a buffer and the NMOS pass device. It should be noted that the Miller capacitor will shunt the input stage amplifier output (also the inverting input of the inverting amplifier) to ground through a filter capacitor at high frequency, thus reducing the sensitivity of the inverting amplifier output to the supply noise; while the second input of the inverting amplifier is most preferably a voltage referenced to ground. This will help the gate of the NMOS pass device better reject supply noise, and hence improve the PSRR. In view of the foregoing, the present invention provides a low drop-out (LDO) architecture that employs an inverting variable gain stage to improve the internal compensation and achieve high PSRR performance from an internally compensated NMOS LDO voltage regulator.

A preferred embodiment of the present invention comprises a differential amplifier input stage, a variable gain, inversion, single stage differential amplifier second stage, and an output stage comprising a series pass NMOS device. The second and output stages are coupled together via an impedance buffer (e.g., source follower, or unity-gain feedback amplifier) to enable the input stage high impedance output to drive the large gate capacitance of the series pass NMOS device and thereby minimize the effect of an internal pole that would otherwise interfere with loop compensation. The inversion, variable gain differential amplifier stage has one input tied to $C_c$ and the other tied to a dc voltage referenced to ground. The Miller capacitance is then tied across multiple stages, i.e. the variable gain stage, the buffer, and the power NMOS.

A feature of the present invention is associated with a higher frequency pole at the filter capacitor achieved through partitioning the LDO into a two stage amplifier and using Miller capacitance for the compensation wherein the $G_m$ of the power NMOS is boosted at low load current and cut down at high load current using a wide band inversion, variable gain stage.

Another feature of the present invention is associated with better PSRR at high frequency by referencing the second input of the variable gain stage to ground thus minimizing the sensitivity of its output to supply noise.

Yet another feature of the present invention is associated with a flexible internally compensated NMOS low drop-out voltage regulator capable of functioning with a wide range of output capacitors and ESR values.

Still another feature of the present invention is associated with providing an internally compensated NMOS low drop-out (LDO) voltage regulator having a Miller compensation loop that remains stable over a wide load current range to maintain the stability of the LDO.

BRIEF DESCRIPTION OF THE DRAWINGS

Other aspects, features and attendant advantages of the present invention will be readily appreciated as the invention becomes better understood by reference to the following detailed description when considered in connection with the accompanying drawings in which like reference numerals designate like parts throughout the figures thereof and wherein.

While the above-identified drawing figures set forth alternative embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
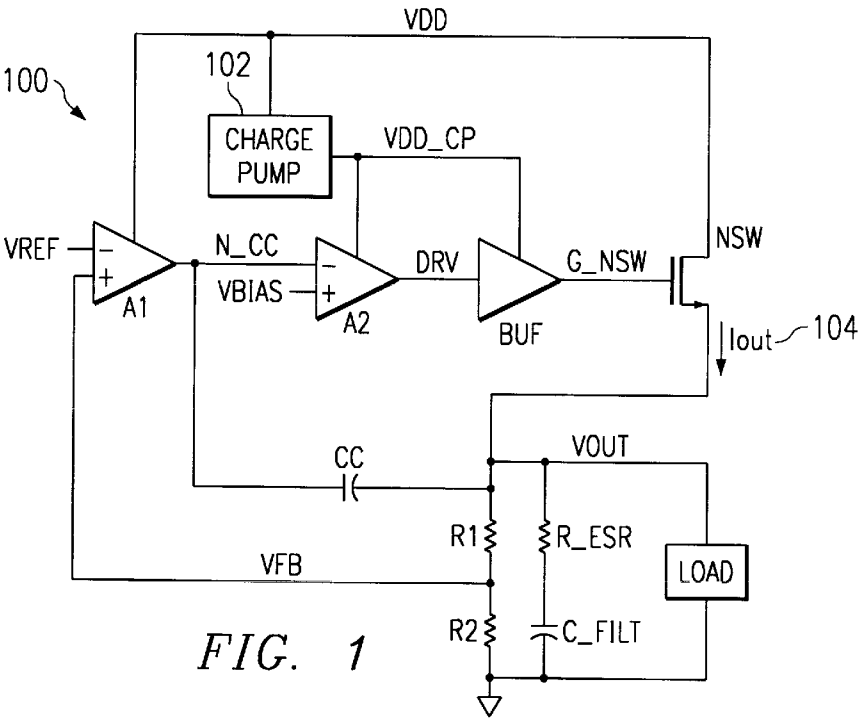
FIG. 1 illustrates a very well known low drop-out (LDO) voltage regulator using an NMOS pass device.

A typical architecture of a Miller compensated NMOS LDO voltage regulator 100 is shown in FIG. 1. The LDO 100 comprises and error amplifier A1, an inverting inter-stage gain amplifier A2, a low impedance driver BUF, a NMOS power transistor NSW, feedback resistors R1 and R2, and an output filter capacitor C_FILT with equivalent series resistor (ESR) R_ESR. The inverting inter-stage gain amplifier A2 and the low impedance driver BUF can be seen to be supplied from a single charge pump 102 that allows the gate of the NMOS power transistor NSW to be pulled up much higher than its drain, thus broadening the input range of the NMOS power transistor NSW. Such a charge pump 102 is generally shared by multiple NMOS LDO's 100.

As with PMOS LDO's, the ultra-wide range of load current Iout 104 (usually from 10's $\mu$A to 100's mA) and the large output filter capacitor C_FILT (1 $\mu$F to 10 $\mu$F) also present significant challenges on compensation designs associated with NMOS LDO's. The LDO 100 depicted in FIG. 1, for example, is very likely still unstable if no special effort is taken to stabilize the Miller compensation loop. A stability analysis of the LDO 100 is now set forth herein below to better demonstrate the stability problems associated with the LDO 100 when subjected to a wide range of load currents.

Figure 2:
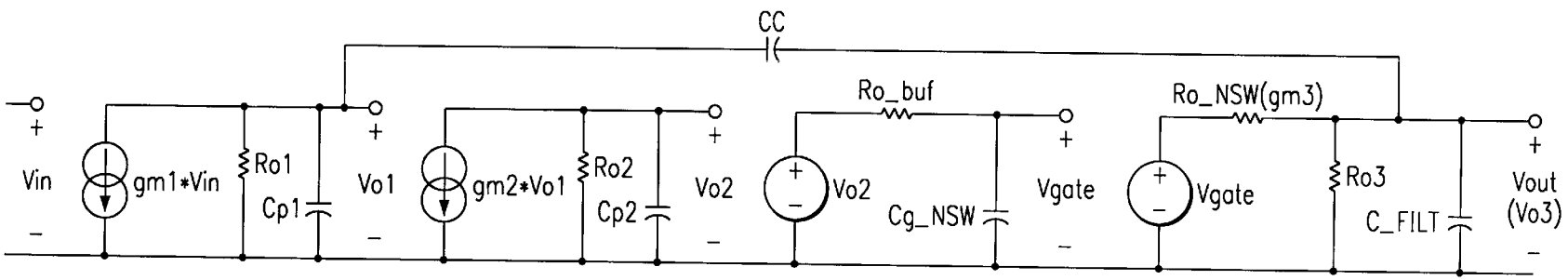
FIG. 2 is a small signal model of the LDO depicted in FIG. 1.

FIG. 2 is a small signal model of the NMOS LDO 100 illustrated in FIG. 1; where resistors Ro1 and Ro2 are the output impedances of A1 and A2; resistor Ro3 is the total resistive load at the final output; capacitors Cp1 and Cp2 are the parasitic capacitance at the outputs of A1 and A2; resistor Ro_buf is the equivalent output impedance of the driver BUF; capacitor Cg_NSW is the total capacitance at BUF output (mainly the NMOS power transistor NSW gate capacitance); and resistor Ro_NSW is the output impedance of the NMOS power transistor NSW, that is the same as its transconductance gm3.

The foregoing stability analysis is commenced by first deriving the pole and zero positions. An analysis of the driver stage is simplified by considering the driver stage to be an ideal unity gain buffer, where $V_{GATE}=V_{02}$. Further, the load at the output of each stage is summed to $Z_{01}$, $Z_{02}$ and $Z_{03}$, where $$Z_{01} = \frac{R_{01}}{1 + sC_{p1}R_{01}},$$

$$Z_{02} = \frac{R_{02}}{1 + sC_{p2}R_{02}} \text{ and}$$

$$Z_{03} = \frac{R_{03}}{1 + sC_{FILT}R_{03}}.$$

Using nodal analysis, the following equations are then obtained:

$$(V_{03} - V_{01}) \cdot sC_P = \frac{V_{01}}{Z_{01}} + g_{m1} V_{in} \quad (1)$$

$$g_{m2} \cdot V_{01} = -\frac{V_{02}}{Z_{02}} \quad (2)$$

$$(V_{02} - V_{03}) \cdot g_{m3} - \frac{V_{03}}{Z_{03}} = (V_{03} - V_{01}) sC_C \quad (3)$$

Similar to the analysis of a Miller compensated two stage amplifier, after reasonable approximations are made, the transfer function appears as:

$$\frac{V_{03}}{V_{in}} = \frac{g_{m1} g_{m2} R_{01} R_{02} \left(1 - \frac{sCc}{g_{m2} R_{02} g_{m3}}\right)}{(1 + sC_C \cdot g_{m2} R_{02} R_{01}) \left(1 + \frac{sC_{FILT}}{g_{m2} R_{02} g_{m3}}\right)} \quad (4)$$

According to equation (4), the dominant pole, second pole and unity gain bandwidth respectively are:

$$f_{pd} = \frac{1}{2\pi \cdot R_{01} (g_{m2} R_{02} C_C)};$$

$$f_{p2} = \frac{g_{m2} R_{02} \cdot g_{m3}}{2\pi \cdot C_{FILT}};$$

$$f_{UGB} = \frac{g_{m1}}{2\pi \cdot C_C}$$

It can be seen from the above equations, the inter-stage gain amplifier A2 serves a critical function to split the poles. Especially at low load current conditions where $g_{m3}$ is minimal, amplifier A2 is expected to have high enough gain (about 50–60 dB) to push the second pole close or beyond the unity gain bandwidth of the LDO. It can be appreciated that a reasonably high output impedance $R_{02}$ is needed to achieve this, for a single stage A2. This high gain associated with amplifier A2 can be problematic at high load conditions however, where the transconductance $g_{m3}$ is very high (i.e., a few hundred mSiemens), and the second pole is pushed up to a few MHz. As discussed in further detail herein below, the second pole is also the unity gain bandwidth of the Miller compensation loop itself, i.e. the local loop from $V_{01}$ to $V_{03}$ back to $V_{01}$. This huge bandwidth nearly always guarantees this local loop is unstable, given the multiple stages inside the local loop, which all contribute to phase shift, albeit at a pretty high frequency range. These concepts are better illustrated by deriving the transfer function from $V_{01}$ to $V_{03}$ in which the frequency response of the driver BUF must be taken into account since the pole at its output will fall into the frequency range of interest. The transfer function of the driver BUF can be assumed to be $$a_{BUF}(s) = \frac{1}{1 + s/p_{BUF}}.$$

Substituting equation (2) into equation (3) and adding $a_{BUF}$ to the $V_{02}$ term produces:

$$(-g_{m2} Z_{02} V_{01} a_{BUF} - V_{03}) \cdot g_{m3} - \frac{V_{03}}{Z_{03}} = (V_{03} - V_{01}) \cdot sC_C \quad (5)$$

Replacing $Z_{02}$ with $$\frac{R_{02}}{1 + sC_{p2} R_{02}}, \quad Z_{03} \text{ with } \frac{R_{03}}{1 + sC_{FILT} R_{03}}, \quad \text{and}$$

$$a_{BUF} \text{ with } \frac{1}{1 + s/p_{BUF}},$$

then provides the following transfer function:

$$\frac{V_{03}}{V_{01}} = \frac{-g_{m2} R_{02} \left(1 + \frac{sC_C (1 + sC_{p2} R_{02})(1 + s/p_{BUF})}{(g_{m2} R_{02} g_{m3})}\right)}{\left(1 + \frac{s(C_{FILT} + C_C)}{g_{m3}}\right)(1 + sC_{p2} R_{02})(1 + s/p_{BUF})} \quad (6)$$

Given that the filter capacitor C_FILT is very large, the dominant pole is most likely at the output. The unity gain bandwidth (assuming a single pole roll-off for the moment) is then given by:

$$f_{UGB(miller)} = \frac{g_{m2} R_{02} \cdot g_{m3}}{2\pi \cdot C_{FILT}},$$

which is also the second pole of the LDO 100. Since equation (6) shows a 3-pole system, the system will be unstable unless one can make the unity gain bandwidth close to or less than the second highest pole. Given that DRV in LDO 100 is a high impedance node, and G_NSW in LDO 100 is a high capacitance node, a bandwidth of a few MHz will make it extremely difficult, if not impossible, to stabilize this Miller compensation loop. The present inventor recognized the foregoing stability problems and that these stability problems could be solved by making the gain of A2 variable with load current (i.e., high gain at light load and low gain at high load).

Figure 3:
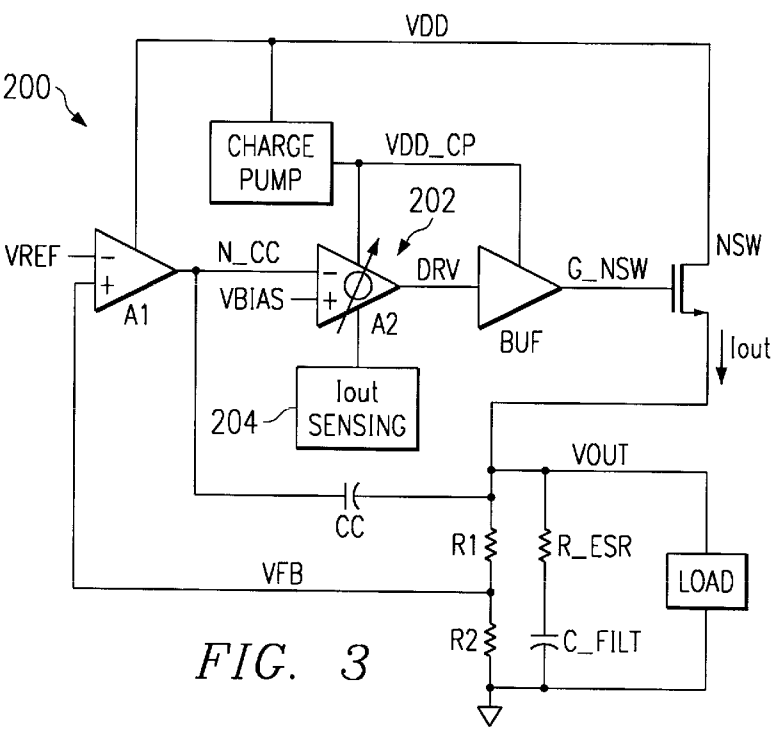
FIG. 3 illustrates an NMOS LDO using a load current controlled variable gain stage according to one embodiment of the present invention.

FIG. 3 accordingly illustrates an NMOS LDO 200 using a load current controlled variable gain stage 202 according to one embodiment of the present invention. LDO 200 is primarily different from LDO 100 in that the inverting inter-stage gain amplifier A2 has a variable gain and a current sensing block 204 to adjust the gain of amplifier A2. According to one embodiment, the gain is at its maximum when load current is light, and then drops continuously in response to an increasing load current. The decreasing amplifier A2 gain ($g_{m2} R_{02}$) then compensates the increased NMOS power transistor NSW transconductance ($g_{m3}$). The span of the unity gain bandwidth of the Miller capacitor loop over a range of load currents is thus greatly reduced, affording a lesser bandwidth to maintain loop stability with changing load current.

Figure 4A:
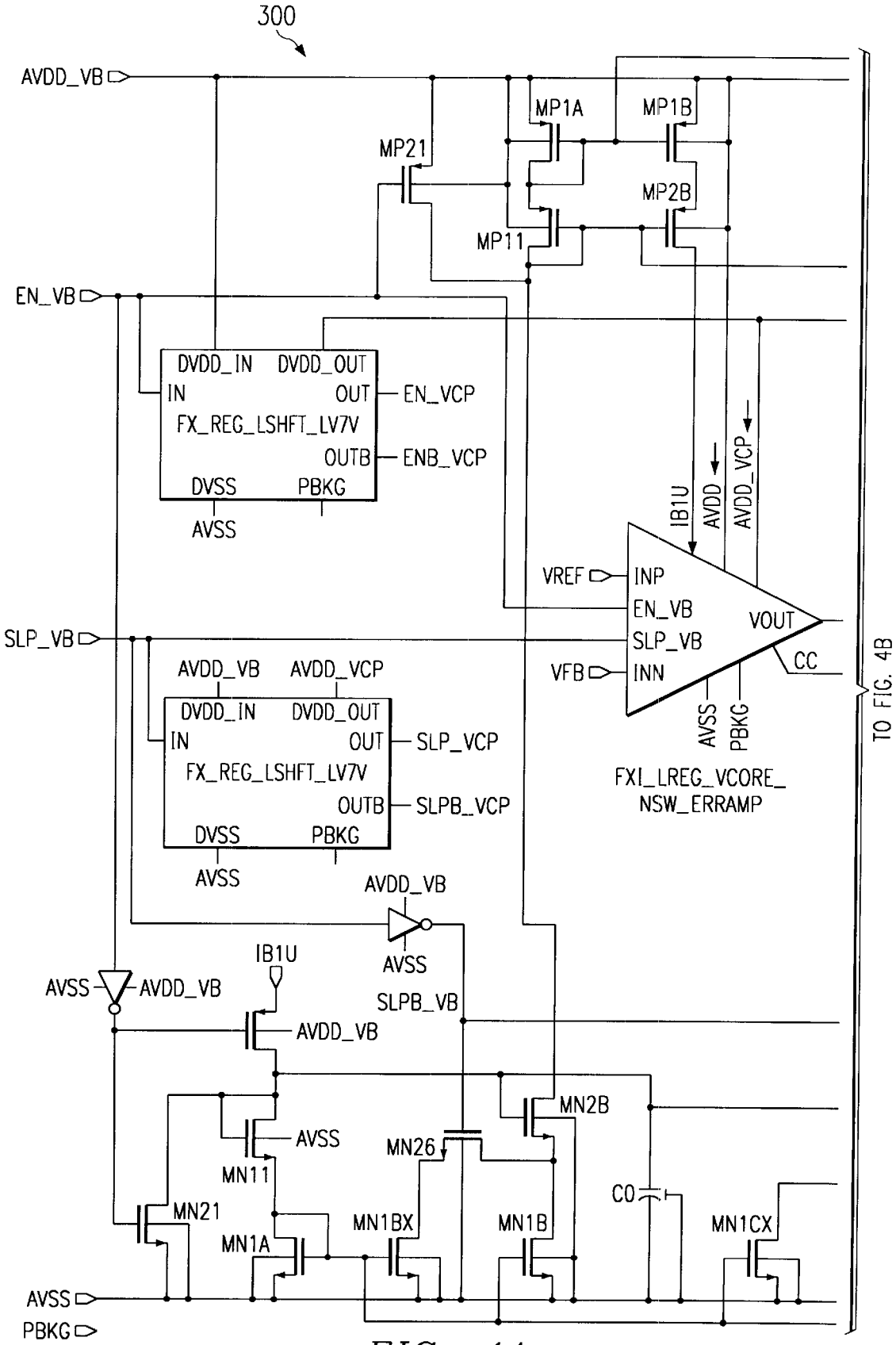
FIG. 4 illustrates an NMOS LDO controller according to one embodiment of the present invention using CMOS process.
Figure 4B:
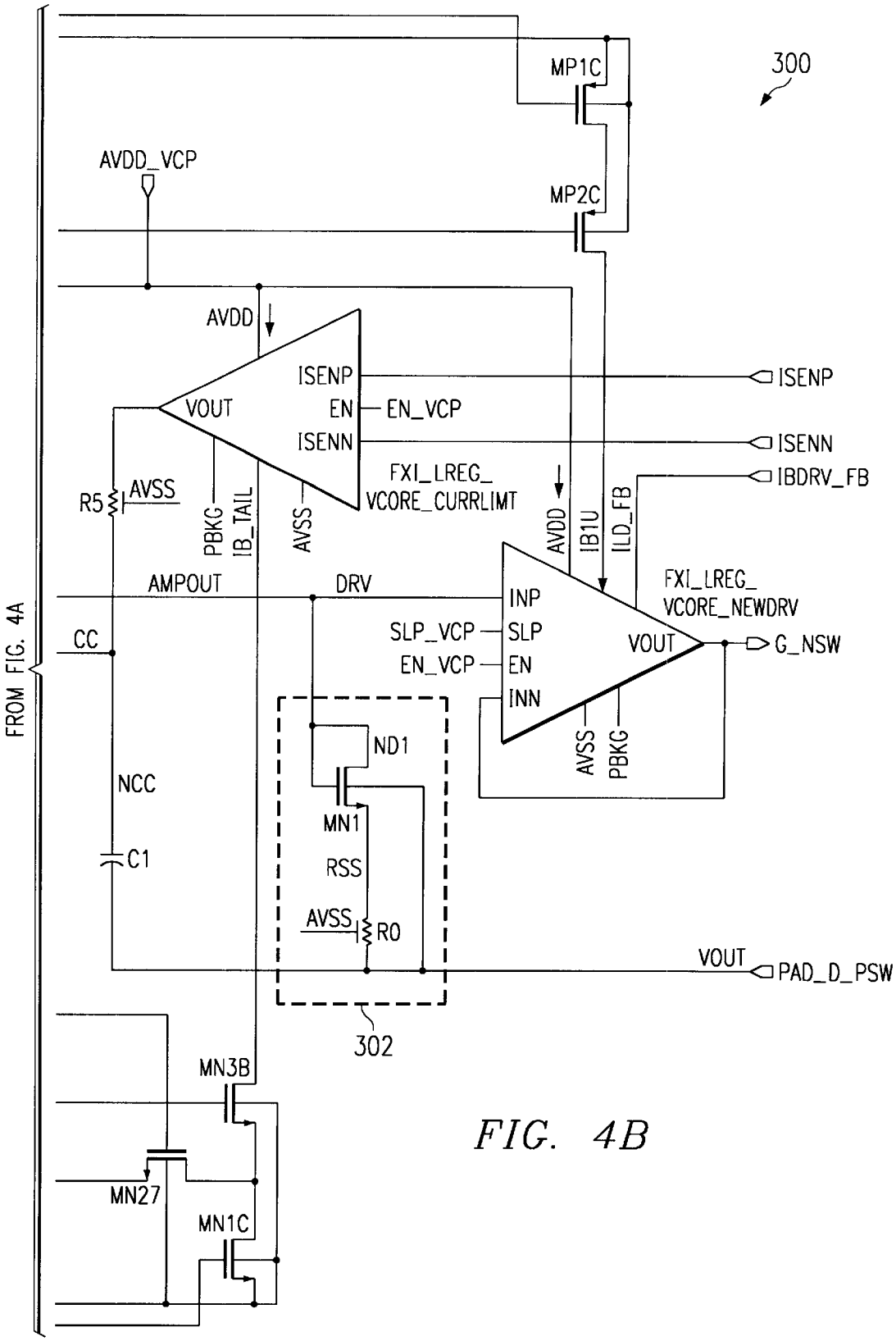

It can be appreciated that although the current sensing block 204 can be implemented in a number of different ways, a preferred embodiment employs a small diode connected NMOS shunt 302 between the output of A2 (DRV) and the output of the LDO (VOUT) such as seen in the LDO controller 300 depicted in FIG. 4. This preferred embodiment only requires that the low impedance driver BUF be a real unity gain buffer without level shift, which excludes any type of source followers. This particular diode NMOS embodiment has multiple benefits as discussed further herein below with reference to FIG. 4.

FIG. 4 illustrates an NMOS LDO controller 300 according to one embodiment of the present invention using a CMOS process. The current sensing circuit (shunt) 302 can be seen to include a diode NMOS ND1 in series with a resistor RSS. The shunt 302 is connected between the DRV node and VOUT, which are also the gate and source respectively of the output power transistor NSW. Under a light load, the $V_{gs}$ of the output power transistor NSW is very small; hence the diode NMOS ND1 is turned off and amplifier A2 can have its maximum gain. As the load increases, the $V_{gs}$ of the output power transistor NSW increases; and the diode NMOS ND1 gradually turns on to shunt the output of amplifier A2 thereby reducing its gain. An important benefit provided by this scheme is associated with the shunt path that also lowers the impedance at the DRV node and helps to push out the parasitic pole as the load current increases. The series resistor RSS can have a value appropriately chosen to limit the current through the diode NMOS ND1 under high loading to ensure a desired minimum gain from the inverting inter-stage gain amplifier A2.

Figure 5A:
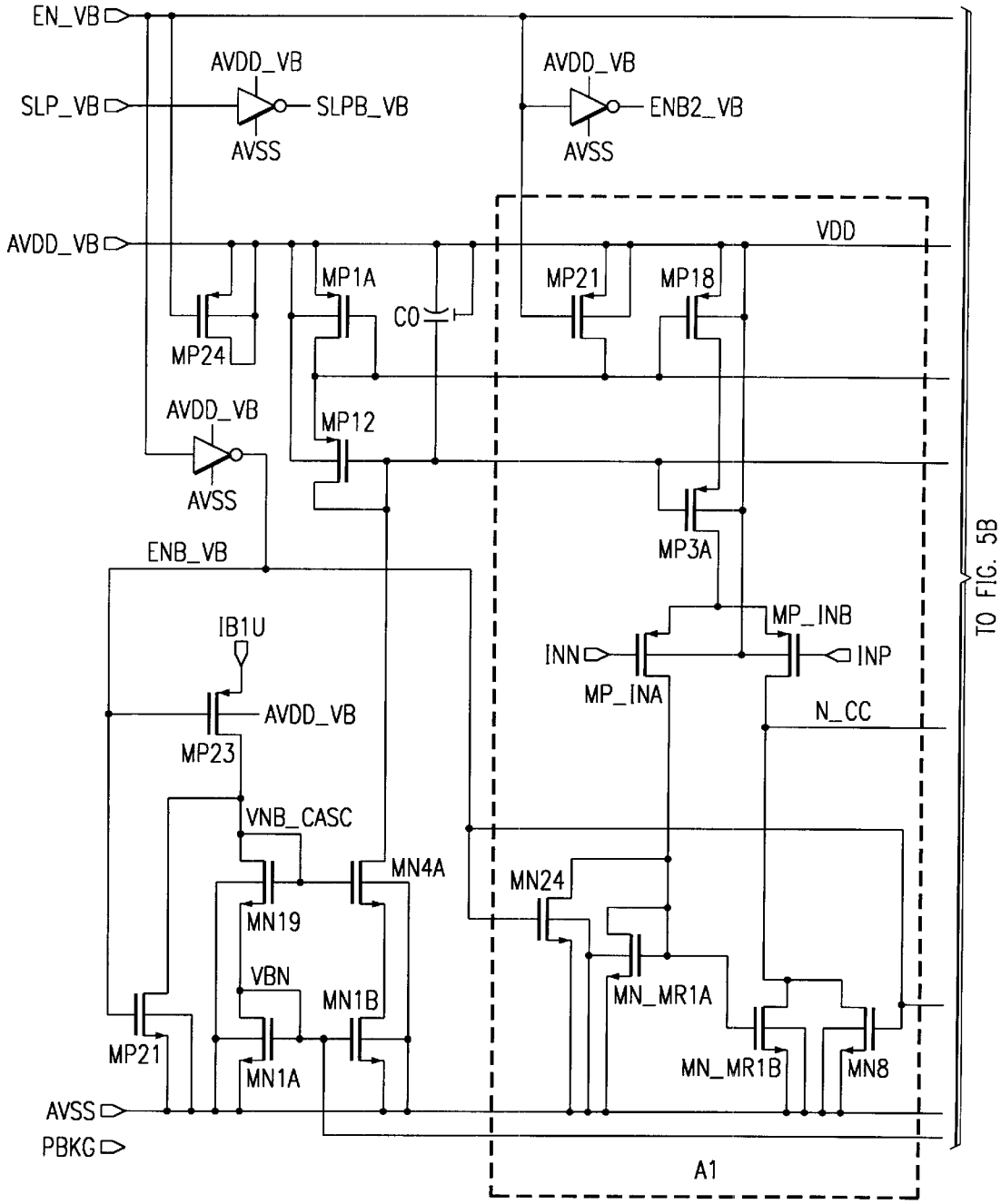
FIG. 5 illustrates a more detailed view of the error amplifier stage and the inversion gain stage of the NMOS LDO controller shown in FIG. 4.
Figure 5B:
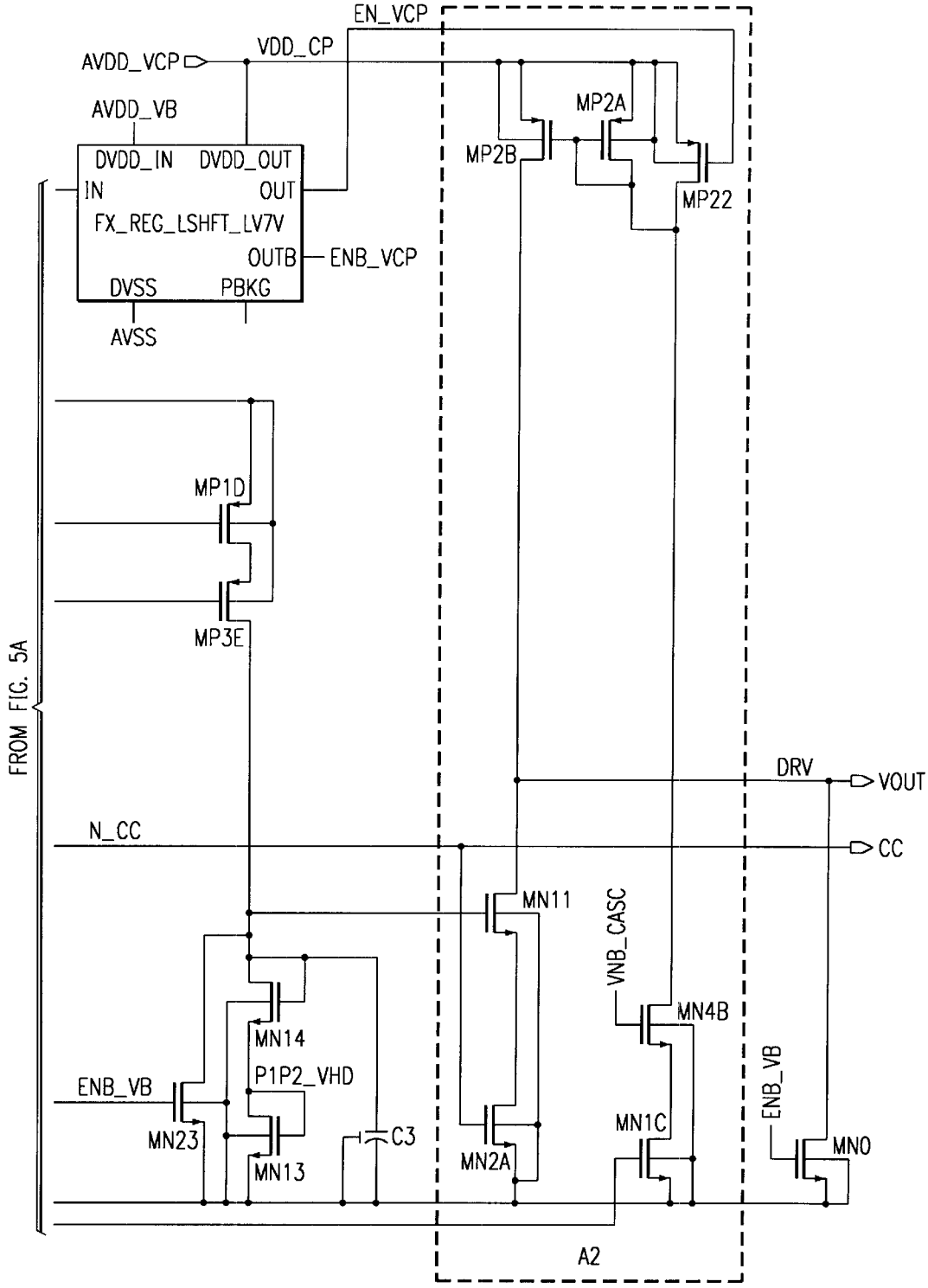

FIG. 5 illustrates a more detailed view of the error amplifier stage A1 and the inversion gain stage A2 of the NMOS LDO controller 300 shown in FIG. 4.

Figure 6:
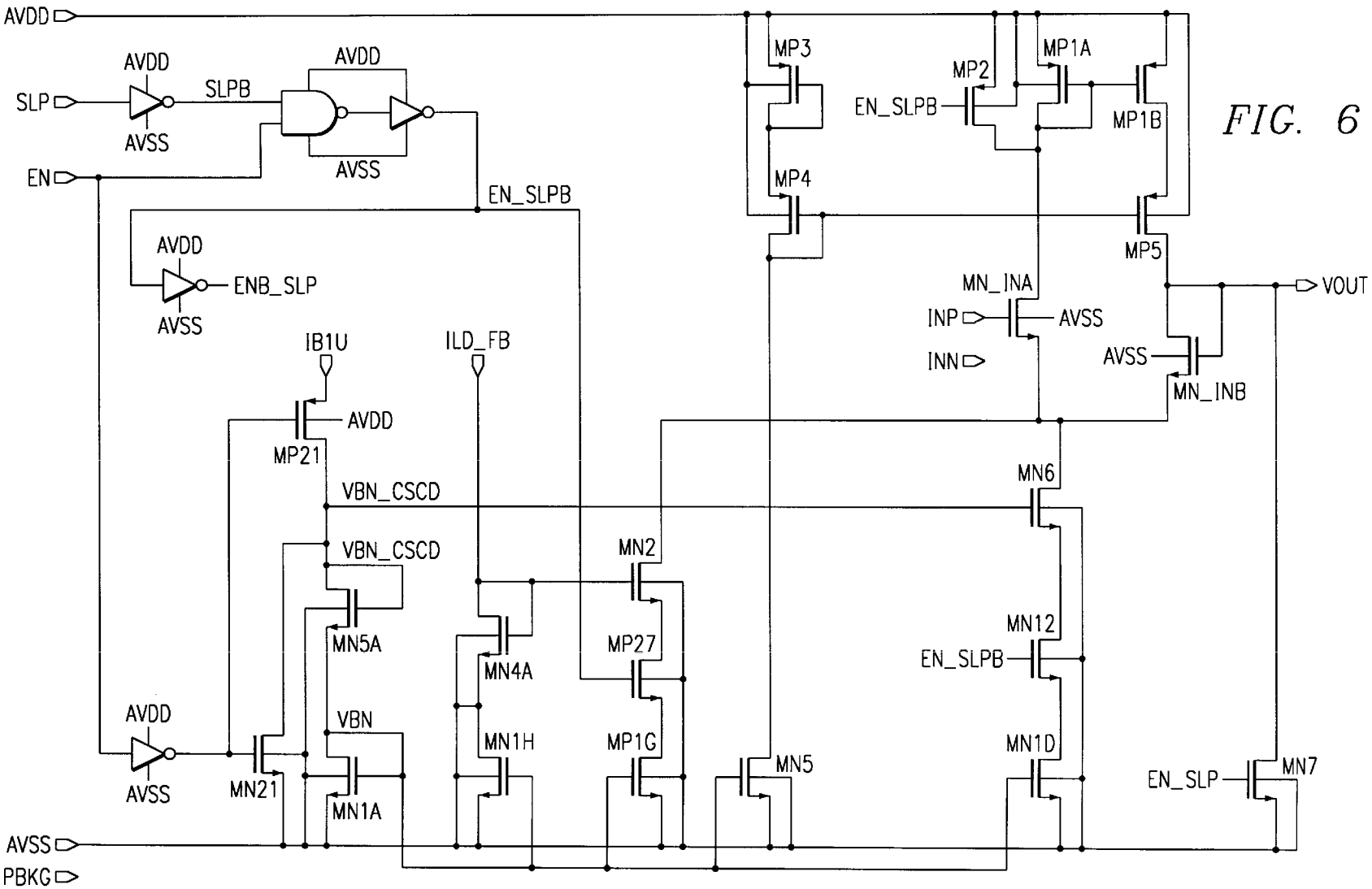
FIG. 6 illustrates a more detailed view of the unity-gain buffer portion of the NMOS LDO controller shown in FIG. 4.

FIG. 6 illustrates a more detailed view of the unity-gain buffer portion of the NMOS LDO controller 300 shown in FIG. 4.

Figure 7:
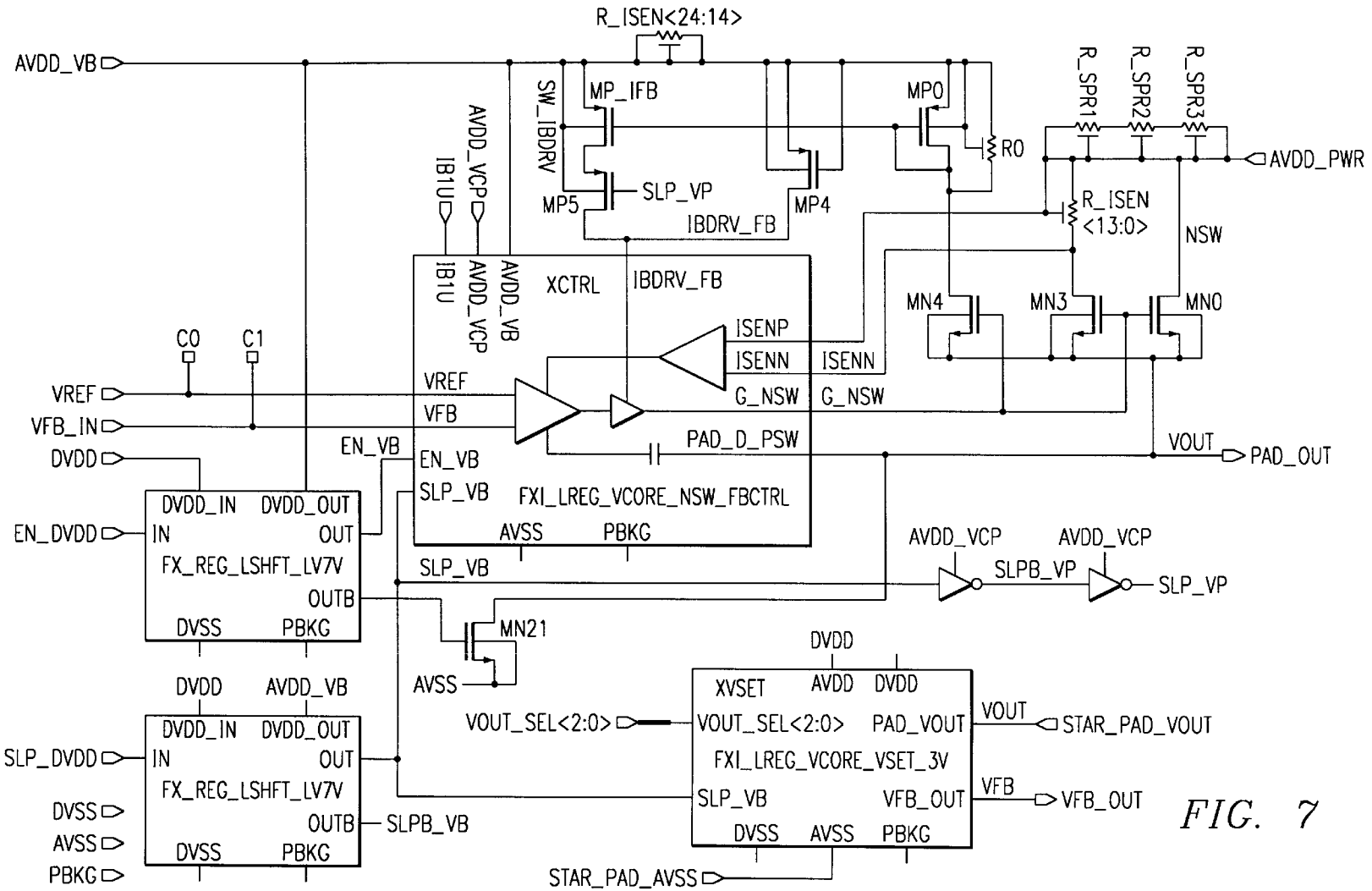
FIG. 7 is a top level schematic diagram of the NMOS LDO controller shown in FIG. 4.

FIG. 7 is a higher (top) level schematic diagram of the NMOS LDO controller 300 shown in FIG. 4.

Figure 8:
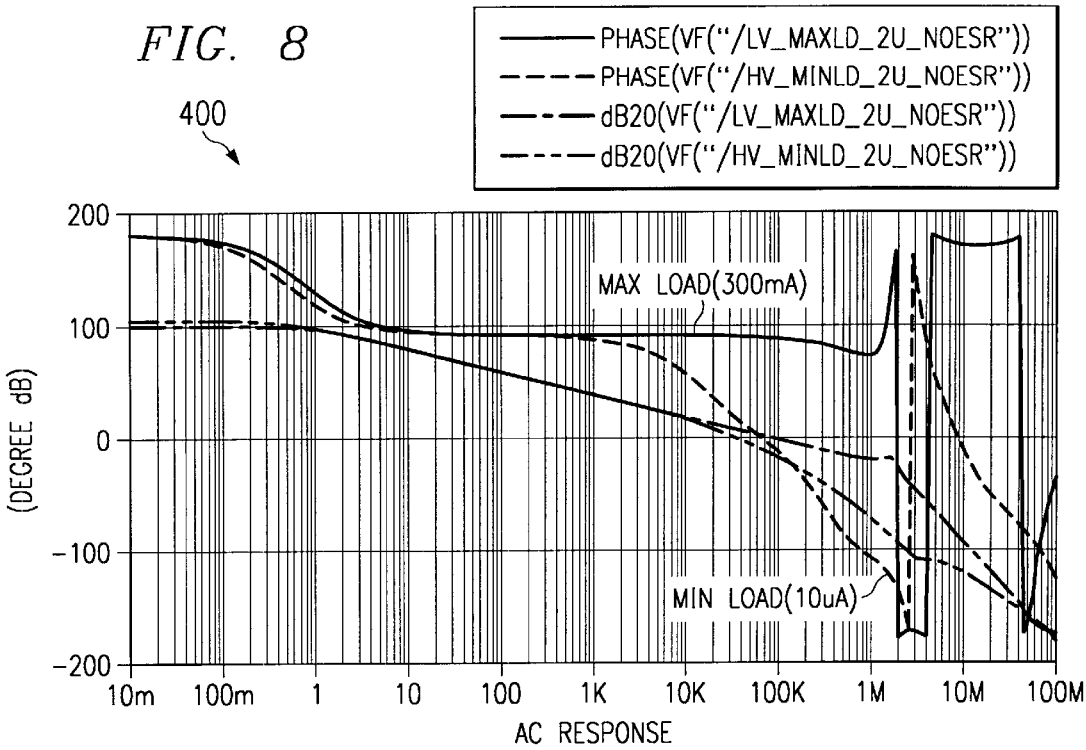
FIG. 8 illustrates an AC response simulation of open loop gain and phase of the NMOS LDO controller shown in FIG. 1 without variable gain amplification under both minimum and maximum load conditions.

FIG. 8 illustrates AC response simulation waveforms 400 of open loop gain and phase of the NMOS LDO controller shown in FIG. 1 without variable gain amplification under both minimum and maximum load conditions.

Figure 9:
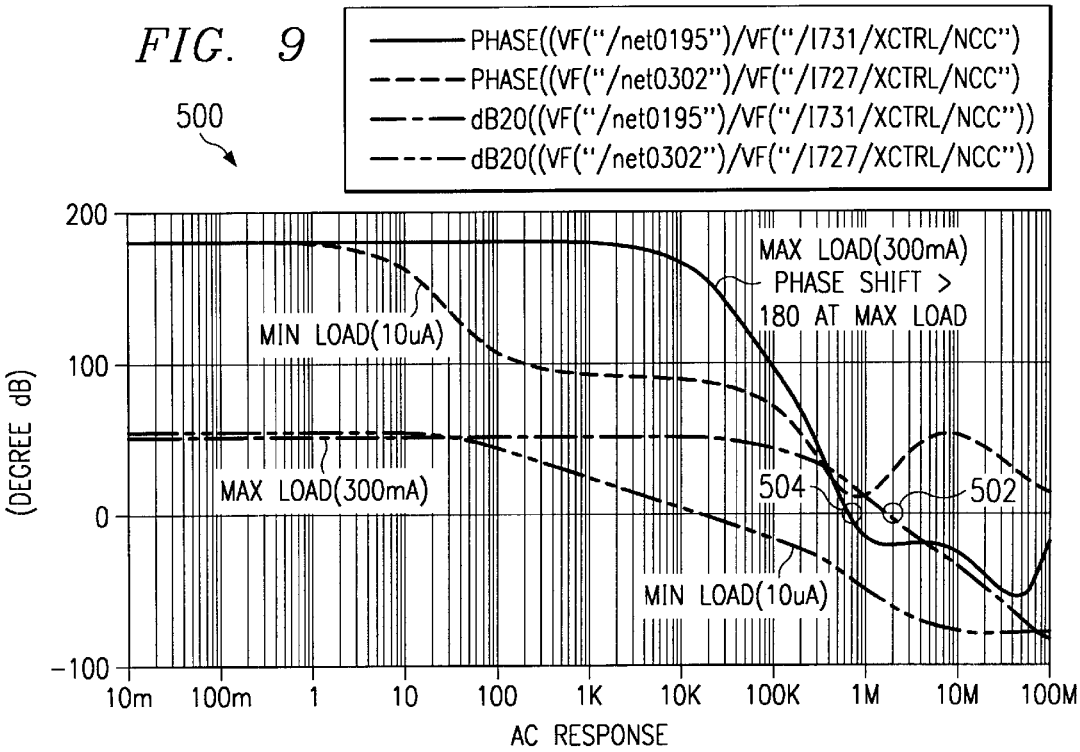
FIG. 9 illustrates an AC response simulation of open loop gain and phase of the Miller loop portion of the NMOS LDO controller shown in FIG. 1 without variable gain amplification under both minimum and maximum load conditions.

FIG. 9 illustrates AC response simulation waveforms 500 of open loop gain and phase of the Miller loop portion of the NMOS LDO controller 100 shown in FIG. 1 without variable gain amplification under both minimum and maximum load conditions. It can be seen that at maximum load (300 mA), the bandwidth of the Miller loop grows to about 2 MHz, depicted as point 502; while the phase shift reaches 180 degrees at about 600 kHz, depicted as point 504. These results indicate an unstable Miller loop that causes the LDO 100 open loop gain to have a peak and corresponding phase jump up as shown in the FIG. 8 waveforms 400. Although it appears this LDO 100 has a good phase margin, a transient simulation will therefore definitely demonstrate that oscillations can occur, indicating the LDO 100 is undesirably unstable under certain operating conditions.

Figure 10:
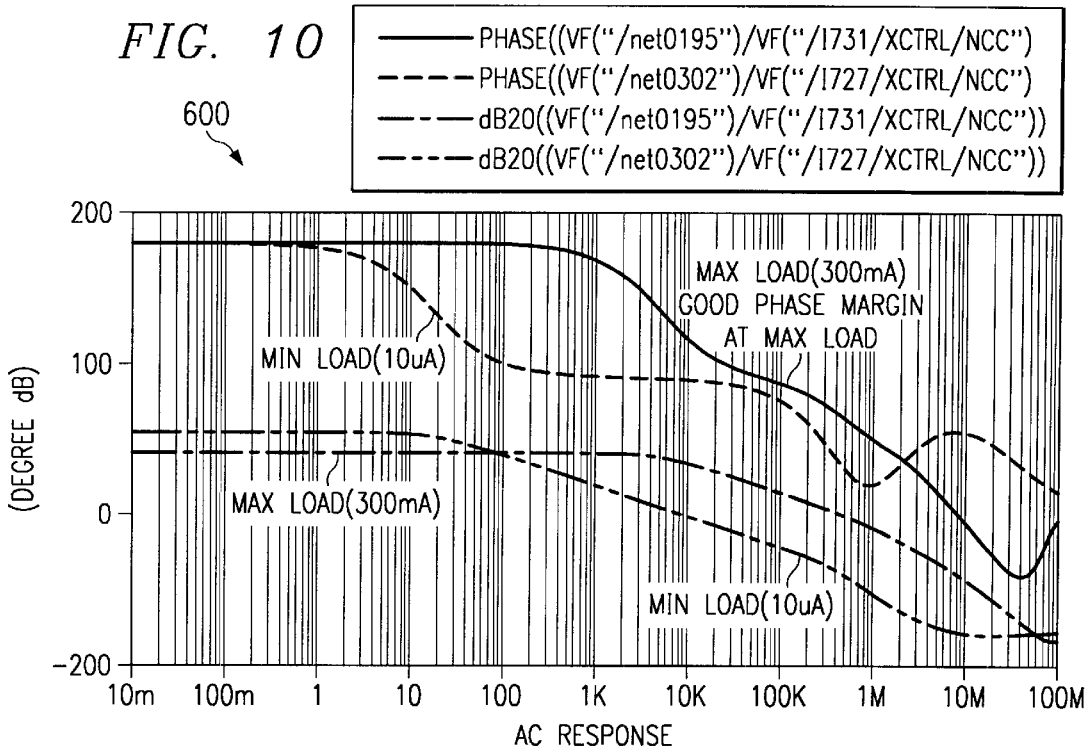
FIG. 10 illustrates an AC response simulation of open loop gain and phase of the Miller loop portion of the NMOS LDO controller shown in FIGS. 3–7 with variable gain amplification under both minimum and maximum load conditions.

FIG. 10 illustrates AC response simulation waveforms 600 of open loop gain and phase of the Miller loop portion of the NMOS LDO controller shown in FIGS. 3–7 with variable gain amplification under both minimum and maximum load conditions.

Figure 11:
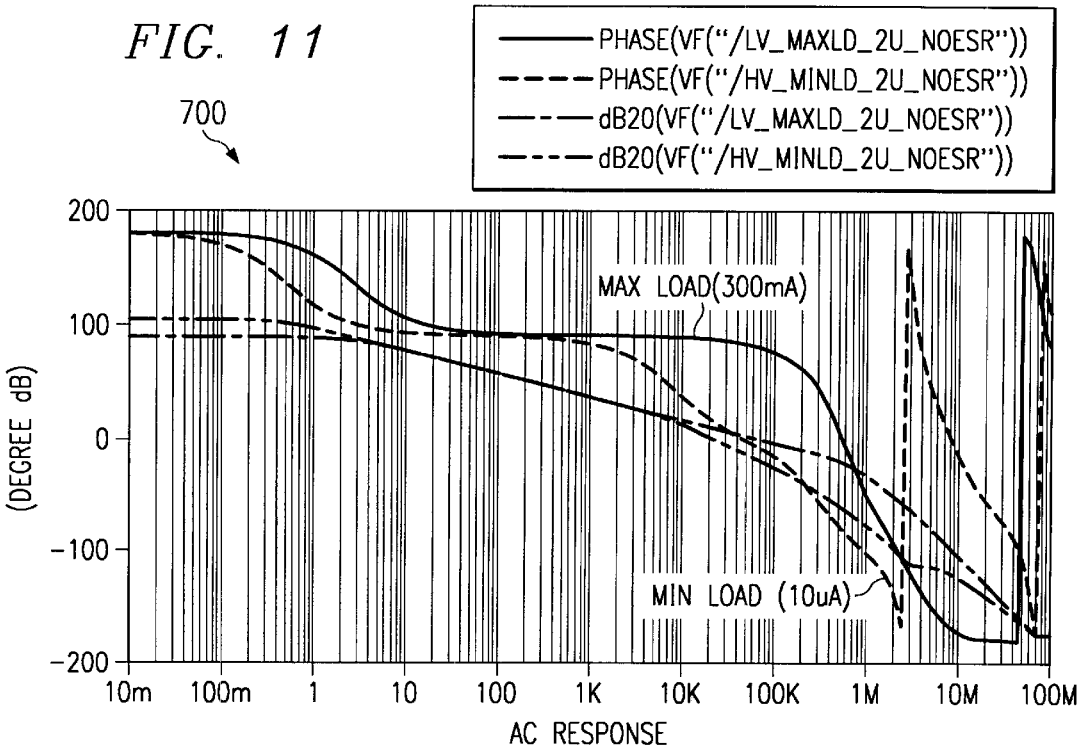
FIG. 11 illustrates an AC response simulation of open loop gain and phase of the NMOS LDO controller shown in FIGS. 3–7 with variable gain amplification under both minimum and maximum load conditions.

FIG. 11 illustrates AC response simulation waveforms 700 of open loop gain to and phase of the NMOS LDO controller shown in FIGS. 3–7 with variable gain amplification under both minimum and maximum load conditions. Comparing FIGS. 11 and 8 at maximum load (300 MA), it can be seen the LDO 300 open loop response no longer has the gain peak and phase jump, and hence looks just like a classic two-stage amplifier response. In summary explanation of the above, by making the gain of amplifier A2 vary with load current, one can maintain a good Miller loop phase margin over a wide load current range, and thereby eliminate one source of instability otherwise associated with a Miller compensated NMOS LDO.

This invention has been described in considerable detail in order to provide those skilled in the LDO circuit art with the information needed to apply the novel principles and to construct and use such specialized components as are required. In view of the foregoing descriptions, it should be apparent that the present invention represents a significant departure from the prior art in construction and operation. However, while particular embodiments of the present invention have been described herein in detail, it is to be understood that various alterations, modifications and substitutions can be made therein without departing in any way from the spirit and scope of the present invention, as defined in the claims which follow. For example, while the embodiments set forth herein illustrate particular types of transistors, the present invention could just as well be implemented using a variety of transistor types including, but not limited to, e.g. CMOS, BiCMOS, Bipolar and HBT, among others. Further, while particular embodiments of the present invention have been described herein with reference to structures and methods of current and voltage control, the present invention shall be understood to also parallel structures and methods of current and voltage control as defined in the claims.

What is claimed is:

1. A modified Miller-compensated voltage regulator having a unity gain frequency, the voltage regulator comprising:

an input error amplifier stage comprising a differential amplifier having an output, a first input and a second input;

an inverting inter-stage variable gain amplifier having an output, a first input in communication with the differential amplifier output, and a second input connected to a dc voltage referenced to ground;

a unity gain buffer amplifier stage having an output, and further having an input in communication with the inverting inter-stage amplifier output;

a power NMOS having a gate in communication with the unity gain buffer amplifier stage output, a drain coupled to a supply voltage and a source that is configured to provide a regulated output voltage; and a compensating capacitor coupled at one end to the source of the power NMOS and coupled at its other end to the output of the input error amplifier stage to provide a compensation loop having internal poles and a unity gain frequency associated therewith.

2. The modified Miller compensated voltage regulator according to claim 1 further comprising a filter capacitor coupled at one end to the source of the power NMOS and coupled at its opposite end to ground.

3. The modified Miller compensated voltage regulator according to claim 1 further comprising a voltage divider coupled to the source of the power NMOS and configured to provide a feedback voltage to the second input of the differential amplifier.

4. The modified Miller compensated voltage regulator according to claim 3 wherein the first input of the differential amplifier is coupled to a predetermined reference voltage.

5. The modified Miller compensated voltage regulator according to claim 1 wherein the inverting inter-stage variable gain amplifier is operational to adjust its gain in response to a load current such that as the load current increases, the gain decreases, wherein the unity gain bandwidth associated with the loop formed by the compensating (Miller) capacitor is kept substantially constant.

6. The modified Miller compensated voltage regulator according to claim 1 wherein the inverting inter-stage variable gain amplifier is operational to push the internal poles in the compensation loop itself formed by the compensating capacitor to frequencies above the unity gain frequency associated with the compensation loop.

7. The modified Miller compensated voltage regulator according to claim 1 wherein the inverting inter-stage variable gain amplifier is operational to adjust its gain in response to a load current such that as the load current decreases, the gain increases, wherein a second pole associated with the voltage regulator is pushed away from the unity gain frequency associated with the voltage regulator.

8. A modified Miller compensated voltage regulator comprising:

a differential amplifier input stage having a first input, a second input, and an output;

an inverting inter-stage variable gain amplifier having an output, a first input connected to a reference voltage, and a second input coupled to the output of the differential amplifier input stage;

a NMOS output transistor having a source, drain and gate;

a unity gain buffer coupling the output of the inverting inter-stage variable gain amplifier to the gate of the NMOS output transistor; and a feedback capacitor coupled at a first end to the NMOS output transistor source, and coupled at a second end to the inverting inter-stage variable gain amplifier second input to form a compensation loop; wherein the inverting inter-stage variable gain amplifier, the unity gain buffer, the NMOS output transistor, and the feedback capacitor are responsive to a changing load current to control a unity gain bandwidth associated with the compensation loop.

9. The modified Miller compensated voltage regulator according to claim 8 wherein the feedback capacitor is referenced at both ends to a common ground associated with the voltage regulator.

10. The modified Miller compensated voltage regulator according to claim 8 further comprising a filter capacitor ($C_{FILT}$) coupled at one end to the source of the power NMOS and coupled at its opposite end to ground.

11. The modified Miller compensated voltage regulator according to claim 10 wherein the unity gain bandwidth associated with the compensation loop is defined by the equation $$f_{bwMILLER} \approx \frac{A_2 \cdot g_{m3}}{2\pi \cdot C_{FILT}},$$

where $A_2$ is a gain associated with the inverting inter-stage variable gain amplifier and $g_{m3}$ is a transconductance associated with the power NMOS.

12. A modified Miller compensated voltage regulator comprising:

an input amplifier stage configured to receive an input reference voltage and further configured to receive a feedback current via a nested Miller compensation capacitor associated with the voltage regulator to generate a displacement current to provide an effective Miller multiplied compensating capacitance;

an inverting inter-stage variable gain amplifier having an output pole associated therewith, the inverting inter-stage variable gain amplifier configured to receive the feedback displacement current associated with the nested Miller compensation capacitor such that the pole associated with the output of the inverting inter-stage variable gain amplifier is pushed out to a frequency above a Unity Gain Frequency associated with the compensation loop and further configured to generate an amplified displacement current signal therefrom; and an output amplifier stage having a pole associated therewith, the output amplifier stage configured to receive the amplified displacement current signal such that the pole associated with the output amplifier stage is pushed out to a frequency above the Unity Gain Frequency of the compensation loop thereby rendering the voltage regulator output stage capable of generating a stable regulated output voltage at frequencies in the vicinity of the control loop bandwidth associated with the voltage regulator.

13. A modified Miller compensated voltage regulator comprising:

means comprising a power NMOS device configured for generating a feedback current;

means for generating a displacement current from the feedback current;

means for amplifying the displacement current such that non-dominant poles associated with the voltage regulator are pushed to frequencies outside the control loop bandwidth of the voltage regulator; and means comprising a unity gain buffer for generating output voltage signals having substantially maximized power supply ripple rejection characteristics inside the control loop bandwidth, wherein the unity gain buffer is operational to receive the displacement current and drive the power NMOS device therefrom.

14. The modified Miller compensated voltage regulator according to claim 13 wherein the means for generating output voltage signals having substantially maximized power supply ripple rejection characteristics inside the control loop bandwidth is devoid of any source followers.

15. The modified Miller compensated voltage regulator according to claim 13 wherein the means for generating a feedback current further comprises a nested Miller compensation capacitor.

16. The modified Miller compensated voltage regulator according to claim 15 wherein the nested Miller compensation capacitor is configured such that each capacitor node is referenced to a common ground associated with the voltage regulator.

17. The modified Miller compensated voltage regulator according to claim 13 wherein the means for generating a displacement current comprises a voltage divider.

18. The modified Miller compensated voltage regulator according to claim 13 wherein the means for amplifying the displacement current such that non-dominant poles associated with the voltage regulator are pushed to frequencies outside the control loop bandwidth of the voltage regulator comprises an inverting inter-stage variable gain amplifier.

19. A modified Miller compensated voltage regulator comprising:

a supply voltage node;

an output voltage node;

a ground;

a differential amplifier having a bias input connected to the supply voltage node, an output, an inverting input connected to a reference voltage, and a non-inverting input;

an inverting inter-stage variable gain amplifier having an output, a reference voltage input connected to a ground reference voltage, and an inverting input in communication with the output of the differential amplifier;

a unity gain buffer having an output, an input in communication with the output of the inverting inter-stage variable gain amplifier, and a supply voltage input configured to receive a supply voltage from a charge pump;

an output power NMOS device having a drain connected to the supply voltage node, a source connected to the output voltage node, and a gate in communication with the output of the unity gain buffer;

a voltage divider network having a first node connected to the power NMOS source, a second node connected to ground, and a third node connected to the differential amplifier non-inverting input to provide a feedback voltage; and a compensation capacitor connected at one end to the power NMOS device source and connected at an opposite end to the output of the differential amplifier to form a compensation loop.

20. The modified Miller compensated voltage regulator according to claim 19 further comprising a filter capacitor coupled at one end to the source of the power NMOS device and connected at its opposite end to ground.

21. The modified Miller compensated voltage regulator according to claim 20 further comprising a current sensing circuit operational to sense load current passing through the NMOS device.

22. The modified Miller compensated voltage regulator according to claim 21 wherein the inverting inter-stage variable gain amplifier, unity gain buffer, power NMOS device, voltage divider network, filter capacitor, compensation capacitor and current sensing circuit are responsive to changes in the load current to control a unity gain bandwidth associated with the compensation loop.

23. The modified Miller compensated voltage regulator according to claim 21 wherein the inverting inter-stage variable gain amplifier is operational to adjust its gain in response to the load current passing through the power NMOS device such that as the load current decreases, the gain increases, wherein a second pole associated with the voltage regulator is pushed above a unity gain frequency associated with the voltage regulator.

24. The modified Miller compensated voltage regulator according to claim 21 wherein the inverting inter-stage variable gain amplifier is operational to adjust its gain in response to the load current passing through the power NMOS device such that as the load current increases, the gain decreases, wherein the unity gain bandwidth associated with the loop formed by the compensation capacitor is kept substantially constant.

25. The modified Miller compensated voltage regulator according to claim 21 wherein the current sensing circuit comprises a diode connected NMOS device configured to shunt the output of the inverting inter-stage variable gain amplifier to the source of the power NMOS device.

26. The modified Miller compensated voltage regulator according to claim 25 wherein the current sensing circuit further comprises a resistor in series with the diode connected NMOS device, wherein the resistor is operational to limit the current passing through the diode connected NMOS device when the current loading is at a predetermined high level such that a desired minimum gain is provided by the inverting inter-stage variable gain amplifier.

27. A method of improving stability associated with a Miller compensated NMOS low drop-out (LDO) voltage regulator comprising the steps of:

providing a differential amplifier input stage, a variable gain, inverting, differential amplifier second stage, and an output stage comprising a series pass NMOS device having a large gate capacitance; and coupling the variable gain, inverting, differential amplifier second stage and the output stage together via an impedance buffer to enable the input stage to drive the large gate capacitance of the series pass NMOS device and thereby minimize the effect of an internal pole that would otherwise interfere with loop compensation.

* * * * *